US007031485B2

(12) United States Patent
Webber et al.

(10) Patent No.: US 7,031,485 B2
(45) Date of Patent: Apr. 18, 2006

(54) EAR MOUNTING ASSEMBLY FOR ELECTRONIC COMPONENT

(75) Inventors: Meridyth Mischel Webber, Teaneck, NJ (US); Lawrence R. Stotts, Elgin, IL (US)

(73) Assignee: Mearrings, Inc., Teaneck, NJ (US)

( * ) Notice: Subject to any disclaimer, the term of this patent is extended or adjusted under 35 U.S.C. 154(b) by 41 days.

(21) Appl. No.: 10/664,102

(22) Filed: Sep. 17, 2003

(65) Prior Publication Data

US 2004/0101151 A1 May 27, 2004

Related U.S. Application Data

(60) Provisional application No. 60/411,281, filed on Sep. 17, 2002.

(51) Int. Cl.
*H04R 25/00* (2006.01)

(52) U.S. Cl. ..... 381/380; 381/328; 381/370

(58) Field of Classification Search ..... 381/322, 381/324, 328, 330, 370, 374, 380–382; 181/129–130
See application file for complete search history.

(56) References Cited

U.S. PATENT DOCUMENTS

| | | | | |
|---|---|---|---|---|
| 2,477,046 | A * | 7/1949 | Davenport | 381/380 |
| 2,506,116 | A * | 5/1950 | Starkey | 181/135 |
| 5,450,496 | A * | 9/1995 | Burris et al. | 381/381 |
| D388,735 | S | 1/1998 | Webber | |
| D393,604 | S | 4/1998 | Webber | |
| 5,809,159 | A * | 9/1998 | Lee | 381/380 |
| 5,828,757 | A * | 10/1998 | Michalsen et al. | 381/328 |
| 5,845,518 | A | 12/1998 | Webber | |
| D475,694 | S | 6/2003 | Bey et al. | |
| 6,819,762 | B1 * | 11/2004 | Jones et al. | 381/380 |
| 2001/0017926 | A1 * | 8/2001 | Vicamini | 381/380 |

* cited by examiner

*Primary Examiner*—Suhan Ni
(74) *Attorney, Agent, or Firm*—Lerner, David, Littenberg, Krumholz & Mentlik, LLP

(57) ABSTRACT

An ear mounting assembly including electronic components to convert audio sounds into signals, preferably electrical signals, is provided. The assembly is constructed and arranged to securely rest within the ear of a user.

21 Claims, 6 Drawing Sheets

EAR MOUNTING ASSEMBLY FOR ELECTRONIC COMPONENT

CROSS REFERENCE TO RELATED APPLICATIONS

The present application claims the benefit of U.S. Provisional Application No. 60/411,281, entitled "EAR MOUNTING ASSEMBLY FOR ELECTRONIC COMPONENT," the disclosure of which is incorporated in its entirety herein by reference.

FIELD OF THE INVENTION

This invention relates generally to devices for mounting or supporting electronic components for receiving and transmitting audio sounds. More particularly, the invention relates to an ear mounting assembly for electronic components, which is removably mounted onto an ear. The ear mounting assembly allows for the transmittal of audio sounds to the auditory canal of the user's ear without materially impairing the user's ability to hear other extraneous and ambient generated sounds.

BACKGROUND OF THE INVENTION

It is well known that sounds can be generated and transmitted by radio wave frequencies and received and converted back into audio frequencies by various devices including earphones. Traditionally, such earphones have been manufactured in the form of headsets to provide audio reception of the converted signals. These headsets have been arranged with a support member or band across the wearer's head whereby the earphone rests against the outer vicinity of the ear and the wearer perceives the audio sounds produced in the earphone. When it is desirable for the wearer to be able to also perceive ambient sounds and engage in direct conversation, a pad that rests against the side of the head is used to replace one of the earphones so that one ear of the user is free to engage in such direct conversation or to hear or listen to other ambient sounds. Such headsets and communication devices are bulky and often result in discomfort for the user.

Additionally, the support members or bands extending across the wearer's head in these prior art devices have disadvantages. For example, they may produce unwanted forces on the wearer's head and they may also interfere with a person's hair. Furthermore, some wearers find them not only uncomfortable but also awkward to use. While such headsets have become smaller, they nonetheless still suffer from similar drawbacks.

Other prior art headsets have been developed for use with small consumer electronic products, such as cellular telephones, portable CD Rom and DVD players, etc. These types of headsets may include an earpiece, which is intended to fit within one or both of a user's ears. All known prior art types of these electronic headsets are designed to entirely block the auditory canal of the ear (i.e., the passageway leading to a user's eardrum) when placed in an assembled position within a user's ear. This arrangement, where the earpiece obstructs the entire auditory canal of an ear, can present a safety hazard as it prevents the user from hearing most ambient sounds and may also result in long term hearing damage to a user.

It is also well known in the prior art that the ear can be used to support ornamental earrings which can be affixed to portions of the ear in various ways. These earring products do not have various structural and operational features of the present invention.

The present invention overcomes the various shortcomings associated with the prior art.

SUMMARY OF THE INVENTION

In one aspect the present invention comprises an electronic headset including a housing having at least one opening therein. The housing may be arranged in an assembled position at least partially within a user's ear such that the at least one opening is directed toward the auditory canal within the user's ear. Electronic circuitry is preferably arranged within the housing. The circuitry is adapted to transmit sound through the at least one opening of the housing. A mounting member may be connected to the housing and is adapted to rest within an external cavity of the ear. A clamp may also be connected to the housing for pivoting movement between a disengaged position where it is remote from the ear, and in an engaged position where it is in contact with the rear side of an earlobe whereby secured assembly of the housing on the ear is obtained.

In accordance with this aspect of the invention, the electronic headset preferably includes an extended portion into which the at least one opening is arranged. The extended portion is arranged substantially adjacent to the auditory canal of a user's ear without preferably entirely occluding the auditory canal.

Further in accordance with this aspect of the invention, the electronic circuitry preferably comprises an electroacoustic transducer.

Preferably, the mounting member includes an arcuate neck portion which provides a resting surface for the housing against the user's ear. In addition, the mounting member also preferably includes at least one bore which is substantially aligned with the opening in the housing so as to form a conduit for the sound being transmitted by the electronic circuitry.

In another aspect, the present invention comprises a housing having at least one opening disposed therein. The housing is preferably adapted to be placed or positioned at least partially within a user's ear. The housing also preferably includes electronic circuitry that is adapted to convert acoustic energy into signals, preferably electrical signals. Further in accordance with this aspect of the invention, the housing includes an extended portion that is positionable substantially adjacent the auditory canal of a user's ear without entirely occluding the auditory canal.

Most preferably, the housing includes a mounting member projecting from the extended portion of the housing. In addition, the mounting member includes an arcuate neck portion that provides a resting surface for the housing against the user's ear.

In a variant, the housing may comprise a mounting member connected to the housing's extended portion such that the mounting member fits in the concha of the user's ear.

In a further variant, the housing may comprise a mounting member that is detachably connectable to the housing's extended portion such that the mounting member fits in the concha of the user's ear.

Further in accordance with this aspect, the electronic circuitry is preferably adapted to transmit sound to a speaker disposed within said housing.

Additional aspects of the invention include the inclusion of additional circuitry within the housing so that the audio information signals may be transmitted and received wirelessly in communications between the electronic headset and a base unit. The base unit may, for example, include a cell phone, a radio, CD-player, a walkman or any other type of device that is suitably adapted to communicate with the headset. The wireless transmitter and receiver preferably communicates with the electronic headset using radio waves, however, infrared transmissions are also possible.

In another aspect, the present invention comprises an ear mounting assembly for electronic components adapted to transmit audio sounds. The assembly may include an inner member having an inner face and an outer face and an enlarged passageway extending transversely therethrough. An outer member is connected to the outer face of the inner member to define a space or chamber in which the electronic components for transmitting the audio sounds are disposed for operative association with one end of the enlarged transverse passageway in the inner member. An ear section is preferably included for removably mounting the ear mounting assembly into an assembled position in the ear space formed at the exterior of the ear inwardly of the antihelix and on the antitragus of the user's ear.

In accordance with a preferred embodiment, the ear section of the ear mounting assembly may include an arcuate section connected at one end to the inner face of an inner member having the enlarged transverse passageway extending therethrough in communication with the electronic components. The ear section also preferably includes a sized and spherically shaped member connected to the end of the arcuate section remote from the end connected to the inner member. Further in accordance with the preferred embodiment, the ear section includes an elongated transverse bore extending end-to-end through the ear section for communication at one end with the enlarged transverse passageway and open to the ambient space exterior of the ear mounting assembly to transmit the audio sounds, signals and communications to the auditory canal of the user's ear without impairing the ability of the user to hear other sounds transmitted to the ambient space. The ear section may also preferably include a clamping assembly pivotally connected to the ear mounting assembly remote from the ear section movable from a disengaged position to an engaged position with the back face of the lobe of the ear for detachably securing the ear mounting assembly and the associated electronic components therein into operative relation with the auditory canal of the ear.

It is another aspect of the present invention to provide an ear mounting assembly for electronic components adapted to transmit audio sounds to the auditory canal of a user's ear having means on the clamping section to adjust the force for holding the ear mounting assembly and the electronic components in assembled position on the user's ear.

It is another aspect of the present invention to provide an ear mounting assembly with associated electronic components for transmitting audio sounds as above described wherein the spherical member has a shaped face at the end remote from the end connected to the arcuate section to position the spherical member in the cavity or concha formed by the antihelix and antitragus section of the user's ear so that the open end of the transverse bore is disposed to pass the audio sounds, signals and communications to the auditory canal of the ear.

The term "spherical member," when used herein, comprises a member where at least a portion thereof is rounded or has a spherical configuration. This includes semi-spherical members, partially spherical members and fully spherical members.

In addition, the term "ear mounting assembly" represents various types of both integral and multi-sectioned infrastructures adapted to be fitted into assembled position on a user's ear. In the preferred embodiment of the present invention, the ear mounting assembly is illustrated as an integral member. However, those skilled in the art will readily recognize that the present invention may have multiple portions defining the infrastructure for the ear mounting assembly or may be of a unitary construction without departing from the scope and purpose of the present invention.

As used herein, the term "electronic headset" shall include the "ear mounting assembly" of the present invention. Thus, "electronic headsets" covers portable ear mounted devices which permit the user to listen to desired sounds transmitted from an associated electronic product such as a cellular telephone, DVD player, CD Rom player and any other electronic audio device.

The applications for the present invention are the same as those for the conventional headsets and thus include, but are not limited to, telephones, announcement devices, personal connectivity devices, audio equipment, paging devices, radio equipment or other communication systems. These applications implement various communication protocols including, but not limited to, Time Division Multiple Access (TDMA), Code Division Multiple Access (CDMA) and Global Systems for Mobile Communications (GSM) for cellular telephones, and Bluetooth™, infrared and IEEE 802.11 for various wireless devices. Thus, the associated electronic components disposed in the ear mounting assembly can be connected to a radio frequency receiving device either by electrical wiring such as used in conventional headsets or by more modern wireless techniques of the above-enumerated applications.

The present invention advantageously provides an ear mounting assembly for electronic components for transmitting audio sounds, which is adapted to be so connected into a user's ear that the audio soundsT can be transmitted to the auditory canal of the user's ear without interfering with the user's ability to hear other ambient sounds.

These and other objects and advantages of the present invention will be more readily understood when considered in conjunction with the detailed description of the present invention which follows the accompanying drawings.

DETAILED DESCRIPTION

Figure 1:
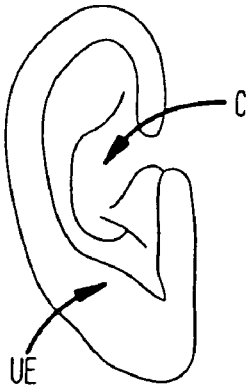
FIG. 1 (PRIOR ART)
FIG. 1 is a picture of a conventional ear to which the ear mounting assembly for electronic components in accordance with the present invention can be connected.
Figure 2:
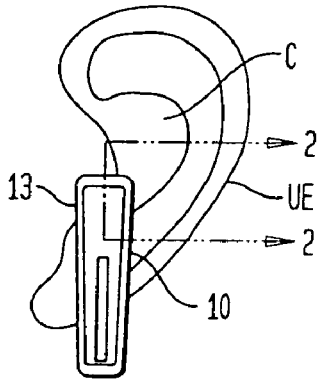
FIG. 2 is a diagrammatic sketch of a preferred embodiment of the ear mounting assembly for electronic components in accordance with the present invention, shown mounted in assembled position on an ear.
Figure 3:
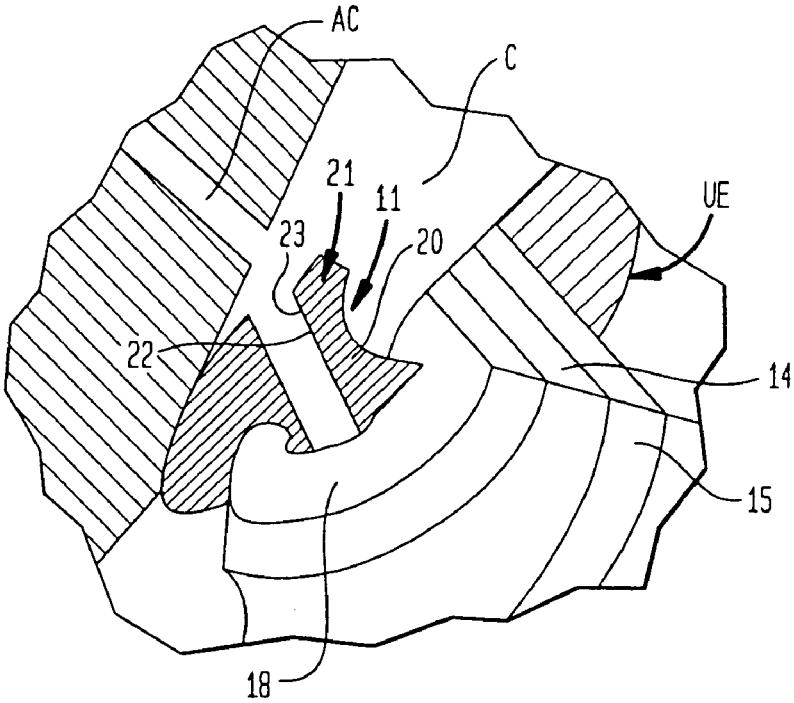
FIG. 3 is a fragmentary cross-section on line 3-3 of FIG. 2 of the drawings.
Figure 4:
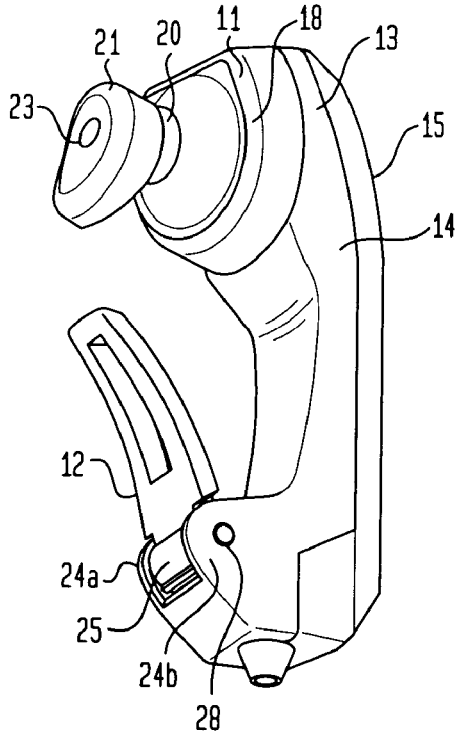
FIG. 4 is a back perspective view of the ear mounting assembly for electronic components shown in FIGS. 2 and 3 of the drawings.
Figure 5:
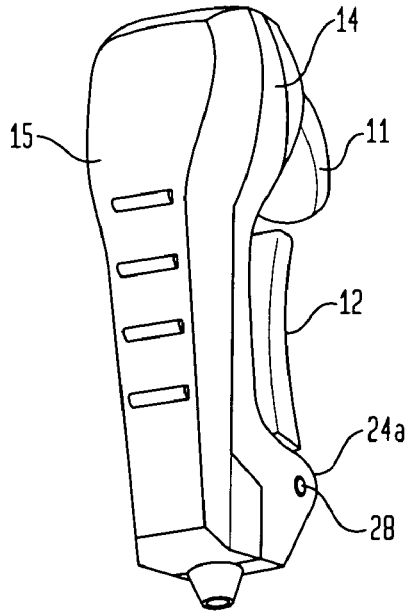
FIG. 5 is a front perspective view of the ear mounting assembly for electronic components shown in FIGS. 1, 4 and 5 of the drawings.

Referring to the drawings, FIGS. 1, 2 and 3 show a preferred embodiment of the ear mounting assembly for electronic components 10 in accordance with the present invention. As shown, the ear mounting assembly 10 is mounted in an assembled position on a User's Ear UE. An ear section 11 of the ear mounting assembly 10 is disposed to rest and fit in the cavity or Concha C of the User's Ear UE so that audio sounds, signals and communications transmitted from the electronic components in the ear mounting assembly, not shown, enter the Auditory Canal AC of the User's Ear UE without interfering with the ability of the User's Ear UE to also hear other ambient sounds, signals and communications. This advantageously allows the user to conduct a conversation and enhances the user's comfort and safety.

FIGS. 1 and 3 further show that the cavity or Concha C of the User's Ear UE is formed at the external portion of the ear by the cartilaginous Antihelix and the Antitragus formed just inwardly of the Lobe L. The ear mounting assembly 10 rests on the Antitragus potion of a user's ear and is further held in place by a clamp 12, which is suitably connected to the user's ear lobe L. The clamp 12 includes adjustable means thereon for asserting the desired forces to comfortably maintain the ear mounting assembly in an assembled position as is hereinafter described.

Figure 8:
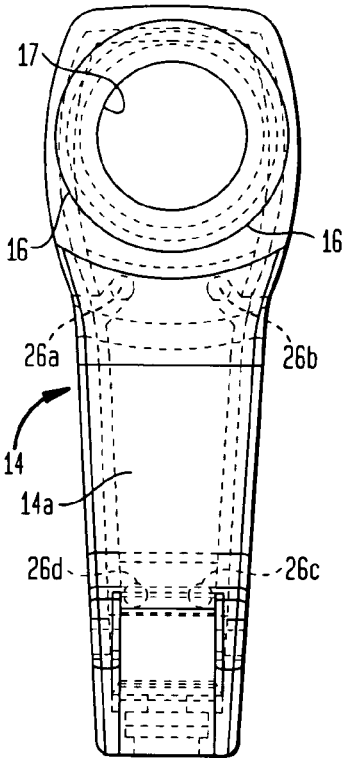
FIG. 8 is a back elevational view of the inner member of the ear mounting assembly for electronic components as shown in FIGS. 4 to 7 of the drawings.
Figure 9:
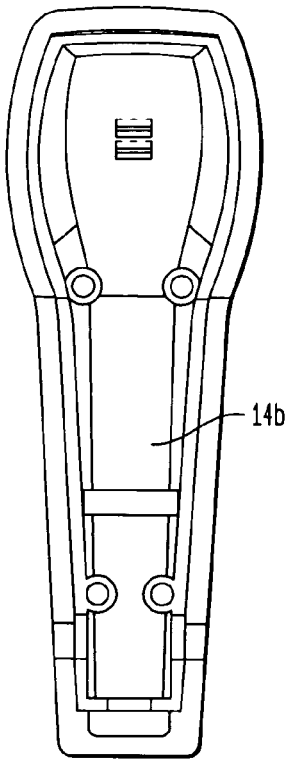
FIG. 9 is a front elevational view of the outer member of the ear mounting assembly for electronic components as shown in FIGS. 4 to 7 of the drawings.
Figure 10:
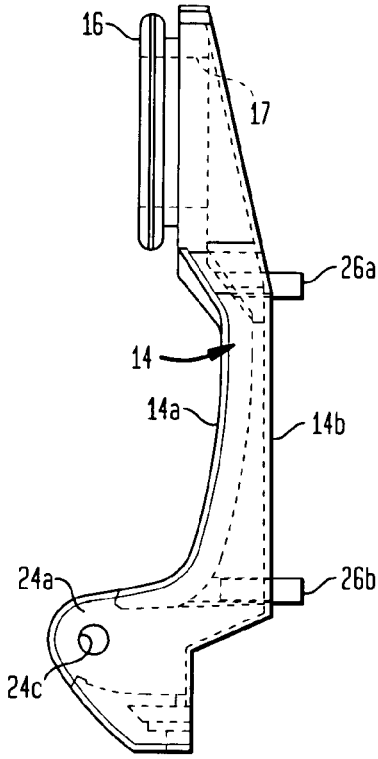
FIG. 10 is a side view of the inner member of the ear mounting assembly for electronic components as shown in FIGS. 4 to 7 of the drawings.
Figure 11:
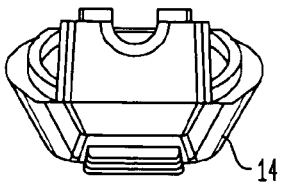
FIG. 11 is a top view of the inner member of the ear mounting assembly for an electronic component as shown in FIGS. 4 to 7 of the drawings.
Figure 12:
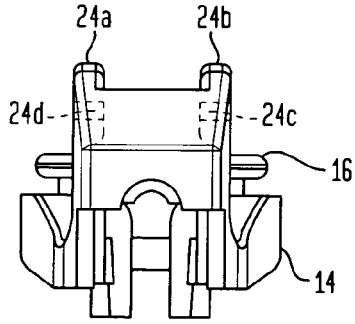
FIG. 12 is a bottom view of the inner member of the ear mounting assembly for an electronic component as shown in FIGS. 4 to 7 of the drawings.

The ear mounting assembly 10 has a relatively small elongated sized and a shaped housing generally designated 13. As best seen in FIGS. 8 and 10, the housing 13 has an inner member 14 and an outer member 15. The inner member 14 has an inner face 14*a* and an outer face 14*b*. The inner member 14 also includes an enlarged housing connecting section 16 at one end in which a main passageway or opening 17 is formed. The main passageway 17 extends transversely through the inner member 14 so that it is open on the housing connecting section 16 at one end and extends through to the outer surface 14*b* at the opposite end. The main passageway 17 serves to transmit sounds, signals and communications from an electronic component, not shown, which is disposed and mounted in an electronic mounting space 13*a* formed in the housing between the inner member 14 and outer member 15. In a preferred embodiment the electronic component comprises an electroacoustic transducer. As such, the ear mounting assembly may be adapted to operate as a speaker or a microphone.

The ear section 11 has a generally cylindrical end section connector 18 at one end which can be affixed to the housing connecting section 16 by any suitable snapping or threaded means 19 for snug engagement to the passageway end of the inner member 14. An arcuate neck portion 20 extends from the end section connector 18. At the opposite end of the neck section 20, a sized and shaped ear cushion or pad 21 is formed. The ear section 11 will fit into the User's Ear UE, so that the arcuate neck portion 20 rests on the Antitragus, thus enabling the ear cushion or pad 21 to rest or lie in the cavity or Concha C of the User's Ear UE. As the ear pad 21 is positioned in the Concha C of the User's Ear UE that portion of the housing 13 that is connected to the opposite end of the ear section 11 generally projects downwardly along the front or outer face of the Lobe L of the User's Ear UE, as is shown in FIGS. 2 and 3 of the drawings.

In a preferred embodiment, the ear section 11 includes a bore 22 having an open end 23 at the end of the air cushion that projects into the Concha C. The bore 22 extends into the ear section 11 through to the main passageway 17. The bore 22 and main passageway 17 provide a channel for communicating audio signals between the user's ear canal and the electronic components located within the housing. In the preferred embodiment, the bore 22 comprises a single opening. Alternatively, in lieu of a bore 22 having a relatively large single opening 23, a plurality of smaller openings may be included at the end of the ear cushion while yet allowing effective communication of the audio signals between the User's Ear UE and the electronic component located within the housing.

Preferably, the air cushion or pad 21 is a generally elongated oval-shaped member having one end connected about the bore end of the arcuate neck section 20 and is sloped at an acute angle to the central line extending from the open end 23 of the bore 22 through the main passageway 17 and cantilevered or offset therefrom so that in the assembled position it can fit comfortably in the cavity or Concha C of the User's Ear UE which has the same general slope. Thus, the ear cushion or pad 21, when in an assembled position, will be disposed at or near the exterior opening of the Auditory Canal AC of the User's Ear UE to enable the audio sounds, signals and communications transmitted through the main passageway 17 and bore 22 to be delivered to the Auditory Canal AC without interfering with any other ambient sounds, signals and communications being received by the User's Ear UE.

At the end of the inner housing 14 remote from the end connected to the ear section 11, the inner housing 14 is provided with the female portion of a hinge as at 24*a* and 24*b* into which a male portion 25 formed on one end of the clamp 12 will engage to pivotally and adjustably connect the clamp 12 into position on the inner housing 14 for operative coaction with the ear section 11 to hold the ear mounting assembly in assembled position on the User's Ear UE as is hereinafter described.

On the outer face of the inner section 14, a plurality of spaced connecting posts 26*a*, 26*b*, 26*c* and 26*d* are formed for coaction with a corresponding number of connecting openings as at 27*a*, 27*b*, 27*c* and 27*d* on the inner face of the outer housing 15 so as to enable the inner housing and outer housing to be connected together to define an electronic component space 13*a* for mounting the electronic components, not shown, in the assembled position in housing 13.

The clamp 12 is pivotally mounted in the hinged portion 24*a* and 24*b* on the inner housing 14 by means of a bore 25*a* which extends transversely through the male portion 25 of the clamp 12. The female portions 24*a* and 24*b* on the end of the inner housing are provided with matching bores 24*c* and 24*d* so that when the male portion 25 of the clamp 12 is inserted in the female portion 24*a* and 24*b* on the inner housing 14, the bores 25*a*, 24*c* and 24*d* align with each other so that a mounting pin 28 can be inserted therethrough to provide a pivoting motion. Thus, the clamp 12 may be moved from a disengaged position relative the Lobe L of the User's Ear UE to an engaged position against the back or rear of the Lobe L to hold and affix the ear mounting assembly 10 into the assembled position on the User's Ear UE, all of which is shown in FIGS. 2, 3, 4, 5, 6, 7, 8, 9. 10 and 13 of the drawings.

Figure 13:
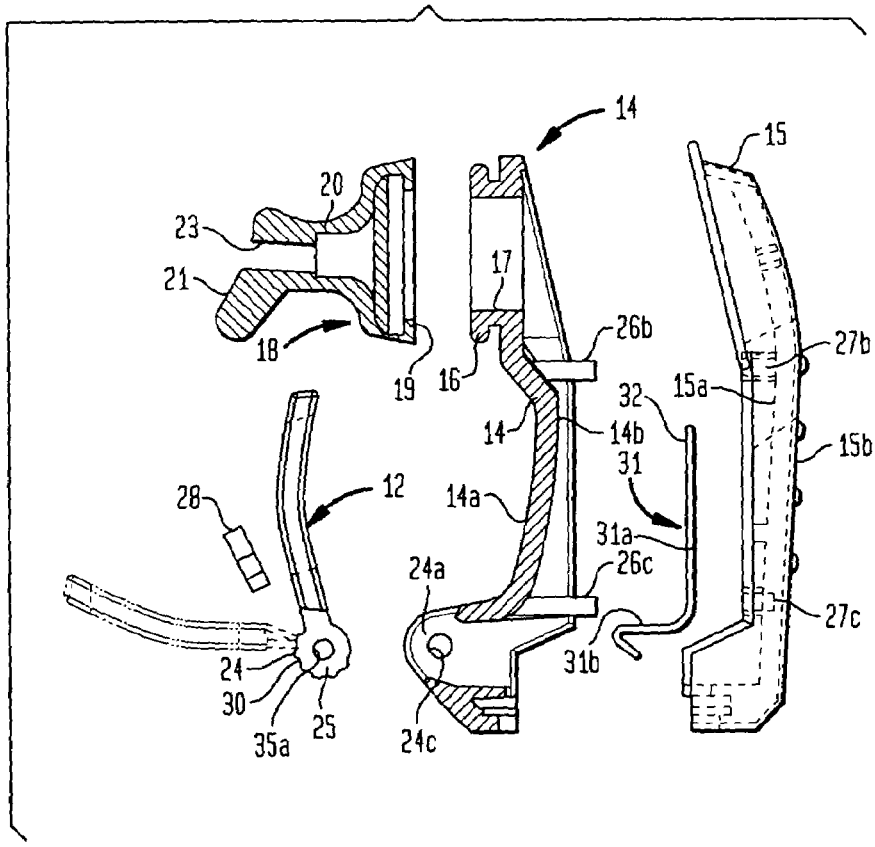
FIG. 13 is an exploded composite cross-sectional view of the elements of the ear mounting assembly for electronic components in accordance with the present invention.
Figure 14:
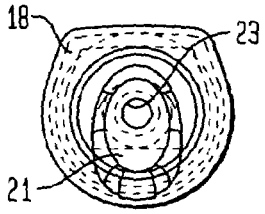
FIG. 14 is a top end view of the ear section of the ear mounting assembly for electronic components as shown in FIGS. 1 to 12 of the drawings.
Figure 15:
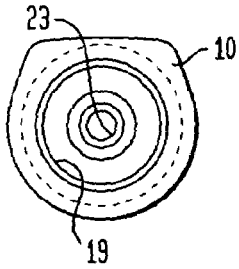
FIG. 15 is a bottom end view of the ear section of the ear mounting assembly for an electronic component as shown in FIGS. 1 to 12 of the drawings.
Figure 16:
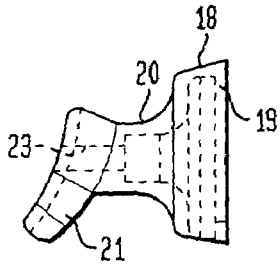
FIG. 16 is a side view of the ear section of the ear mounting assembly for electronic components as shown in FIGS. 1 to 12 of the drawings.
Figure 17:
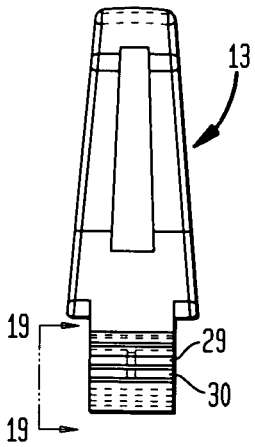
FIG. 17 is a back view of the clamping section for the ear mounting assembly for electronic components as shown in FIGS. 1 to 12 of the drawings.
Figure 18:
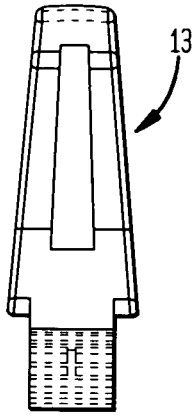
FIG. 18 is a front view of the clamping section for the ear mounting assembly for electronic components as shown in FIGS. 1 to 12 of the drawings.
Figure 19:
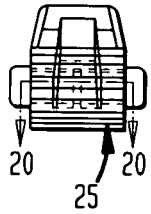
FIG. 19 is a bottom view of the clamping section of the ear mounting assembly for electronic components shown in FIGS. 1 to 12 of the drawings.
Figure 20:
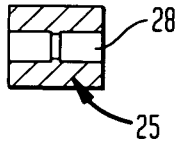
FIG. 20 is a cross-section taken on line 20-20 of FIG. 17.
Figure 21:
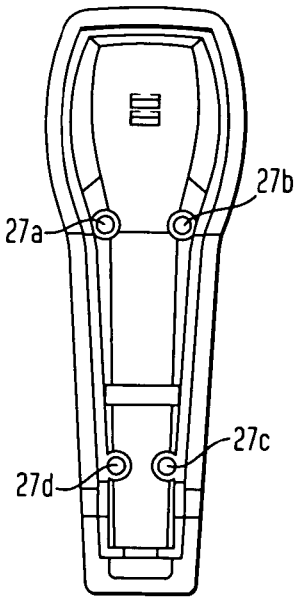
FIG. 21 is a front view of the outer member of the ear mounting assembly for electronic components shown in FIGS. 1 to 12 of the drawings.
Figure 22:
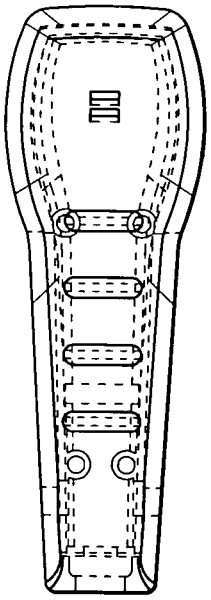
FIG. 22 is a back view of the outer member of the ear mounting assembly for electronic components shown in FIGS. 1–12 of the drawings.
Figure 23:
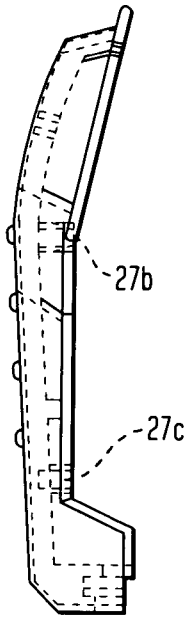
FIG. 23 is a side elevation of the outer member of the ear mounting assembly for electronic components shown in FIGS. 21 and 22 of the drawings.
Figure 24:
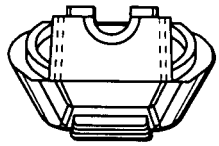
FIG. 24 is a top view of the outer member of the ear mounting assembly for electronic components shown in FIGS. 21, 22 and 23 of the drawings.

FIGS. 4, 6, 7, 13, 17, 18, 19 and 20 further show that the male portion of the clamp 12 is provided with a plurality of ridges and grooves as at 29 and 30. In the assembled position these ridges and grooves coact with a resilient member 31 as is shown in FIG. 13 of the drawings. Resilient member 31 is a generally L-shaped member having an elongated leg 31*a* and a projecting leg 31*b* connected end-to-end to the elongated leg 31*a*. The elongated leg 31*a* is connected as by rivets or other suitable means 32 on the inner face 15*a* of the outer housing 15 so that the projecting leg 31*b* will extend into the inner housing 14 for engagement with the ridges and grooves 29 and 30 formed on the male portion 25 of clamp 12, to hold the clamp when it is moved into the engaged position with the back end of the Lobe L of the User's Ear UE.

Since there are a plurality of ridges and grooves, the coaction between the ridges and grooves 29 and 30 and the resilient member 31 enables the force exerted by the clamp 12 to be adjusted when pivoted into the engaged position for holding the ear mounting assembly in assembled position.

While the electronic components are not shown, those skilled in the art will recognize that depending on the application, the electronic component will include a simple circuit including a speaker and driver electronics to receive and convert signals into audible sounds, signals and communications. More advanced protocols including, but not limited to, TDMA, CDMA or GSM for cellular telephones and Bluetooth™ or IEEE 802.11 or infrared technology for other wireless devices may require additional circuitry.

In the case of a wireless embodiment of the present invention, the electronic components, not shown, would include electronic devices to implement the select components therein, and the transmitting device may use wireless technology. In such wireless embodiment, the electronic component would be devices to implement the selected wireless technology, allowing the ear mounting assembly to receive and process signals for a transmitting device.

Figure 6:
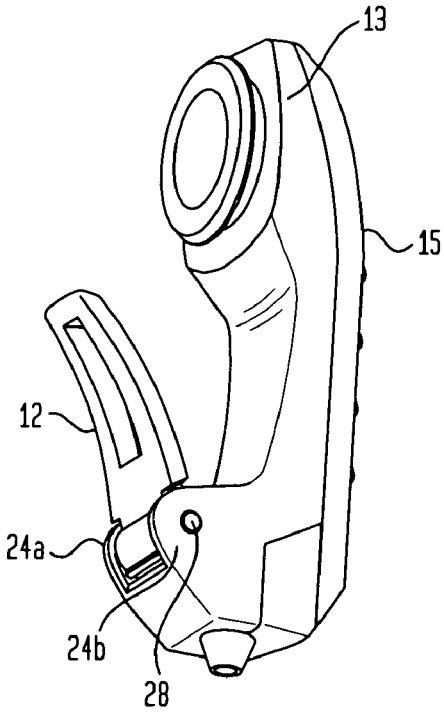
FIG. 6 is the same perspective view of the ear mounting assembly for electronic components shown in FIG. 4 of the drawings with the ear section removed.
Figure 6A:
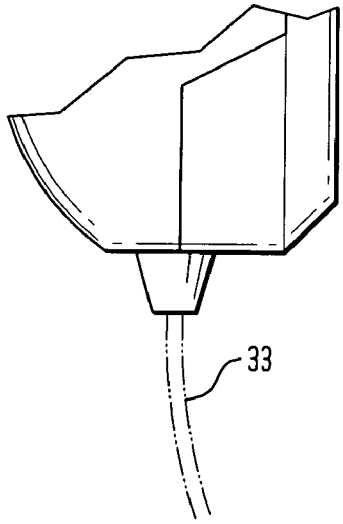
FIG. 6A is an enlarged fragmentary view of the connecting point on the ear mounting assembly for electronic components shown in FIGS. 4, 5 and 6 of the drawings showing where an electrical conducting wire can be added for communication with other electronic devices for transmitting electronically, sounds, signals and other communications.
Figure 7:
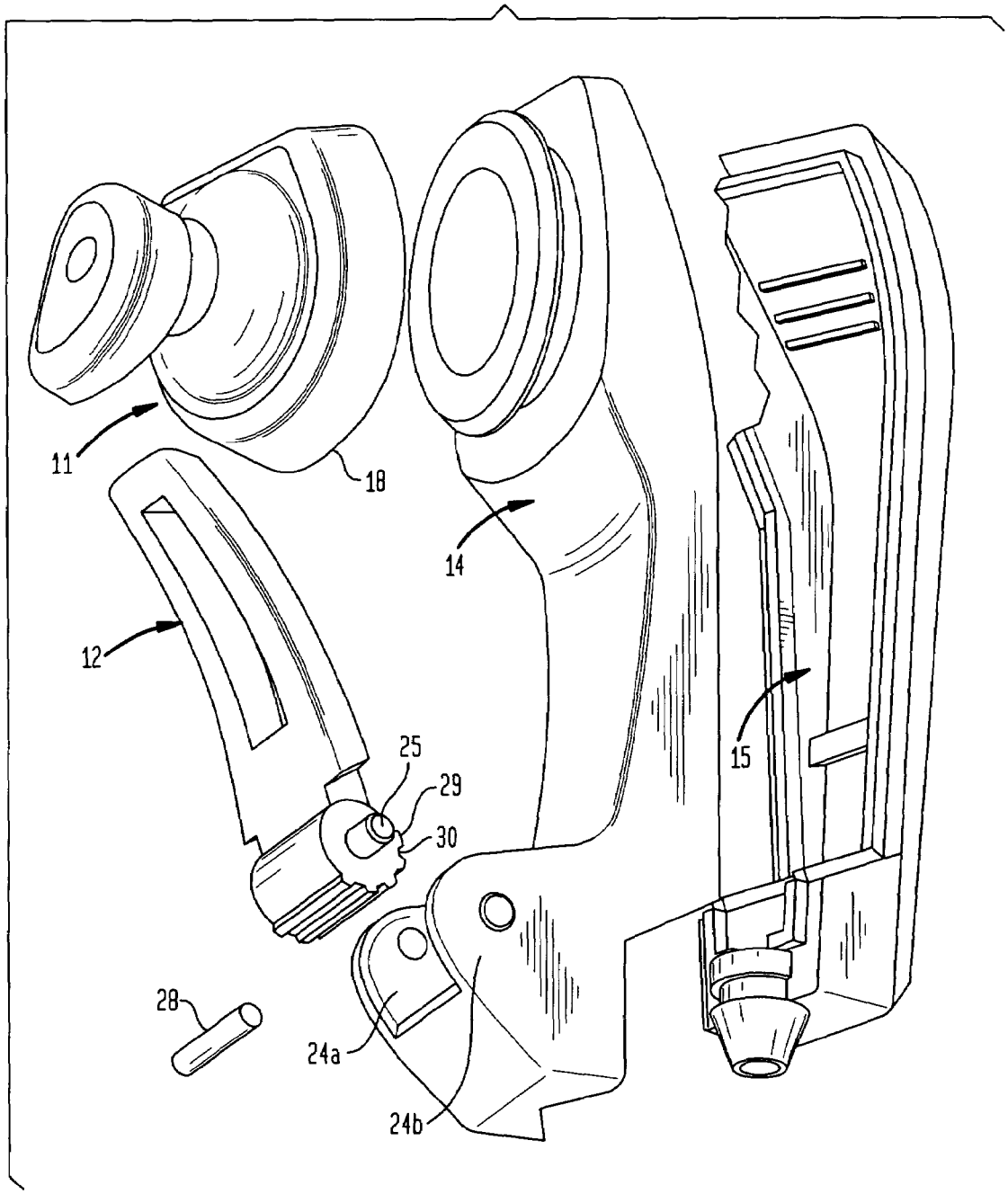
FIG. 7 is an exploded view of the ear mounting assembly for electronic components shown in FIGS. 4 to 7 of the drawings.

In an alternate embodiment, as shown in FIG. 6A, a wire connection 33 is provided to communicate with the device transmitting the signals to be converted into audio sounds, signals and communications.

The outer surface 15*b* of the outer casing 15 may optionally include decorations for aesthetic purposes.

In still another alternate embodiment, the electronic component in the ear mounting assembly could include electronics to send electronic signals to a transmitting device as well as receive such signals either through a wireless technology or by wire.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An electronic headset, comprising:

(a) a housing having at least one opening therein and an endface at which said at least one opening terminates, said housing being adaptable to be arranged at least partially within an ear of a user such that said at least one opening is directed toward the auditory canal within the user's ear;

(b) electronic circuitry arranged within said housing, said circuitry being adapted to transmit sound through said at least one opening of said housing;

(c) a mounting member connected to said housing and being adapted to rest within the user's ear; and (d) a clamp connected to said housing for pivotal movement away from said end face where it is remote from the user's ear, and movement toward said end face where it is in contact with the user's earlobe whereby secured assembly of the housing on the ear can be obtained.

2. The electronic headset of claim 1 wherein said housing includes an extended portion, said at least one opening arranged through said extended portion, said extended portion arranged substantially adjacent the auditory canal of a user's ear but does not entirely occlude the auditory canal.

3. The electronic headset of claim 2 wherein said mounting member is connected to said housing at said extended portion.

4. The electronic headset of claim 1 wherein said electronic circuitry comprises an electroacoustic transducer.

5. The electronic headset of claim 1 wherein said housing includes an inner member and an outer member connected to the inner member to define a chamber for mounting the electronic circuitry therein.

6. The electronic headset of claim 1 wherein said mounting member includes an arcuate neck portion which provides a resting surface for the housing against the user's ear.

7. The electronic headset of claim 1 wherein said mounting members has at least one bore formed therein, said at least one bore being substantially aligned with said at least opening to form a conduit for the sound transmitted by said electronic circuitry.

8. An ear mounting assembly for electronic components having means for transmitting audio sounds, signals and communications to removably secure the electronic components in the cavity and on the lobe of the user's ear to enable the sounds, signals and communications to pass along with other sounds to the auditory canal of the user's ear comprising:

(a) a housing having an inner member and an outer member connected to the inner member to define a chamber for mounting the electronic components in the housing, (b) said inner member having an inner face and an outer face, a main passageway extending transversely thereof, said passageway having one end adjacent the chamber and another end opening onto the inner face for transmitting the audio sounds, signals and communications, and a connecting means on the inner surface about the opening formed by the passageway, (c) an inner section having an arcuate section, and a connector about the end of the arcuate section for connecting the ear section to the inner surface of the inner housing, and a shaped ear pad connected to the end of the arcuate section remote from the connected end of the arcuate section, and a bore extending end-to-end through the ear section communicating at one end with the enlarged passageway and at the other end open for transmitting the audio sounds, signals and communications, and (d) a clamping assembly pivotally connected to the inner housing remote from the ear section removable from a disengaged position to an engaged position with the lobe of the user's ear for detachably connecting the ear mounting member and the electronic components therein into operative relation with the auditory canal of the ear to pass said sounds, signals and communications to the auditory canal without interfering with the ability of the ear to hear other sounds.

9. In the ear mounting assembly for an electronic component as in claim 8, including means on the clamping section to adjust the force for holding the backing means and electronic component in assembled position.

10. In the ear mounting assembly for electronic components as in claim 8, wherein the ear pad has an oval-shaped face at the end remote from the end connected to the arcuate section to enable the ear pad to be fitted into the cavity of the ear when the ear mounting assembly is connected to the ear for passing the audio sounds, signals and communications to the auditory canal of the ear.

11. An electronic headset, comprising:

a housing having at least one opening disposed therein and an endface defining a surface at which said at least one opening terminates, said housing being positionable at least partially within an ear of a user such that said endface rests within the user's ear and such that said at least one opening is directed towards the auditory canal within the user's ear;

electronic circuitry arranged within said housing, said circuitry being adapted to convert electronic signals into acoustic energy; and a clamp-connecting member coupled to said housing and operable to move toward said endface surface to a first position proximate the ear lobe of the user such that the electronic headset is secured against the ear of the user and away from said endface surface to a second position such that the electronic head set may be removed from the ear of the user.

12. The electronic headset of claim 11 wherein said clamp-connecting member is pivotably mounted to said housing.

13. The electronic headset of claim 12 wherein said clamp connecting member is pivotably mounted to said housing using an assembly that allows a force exerted on the user's ear lobe to be adjusted.

14. The electronic headset of claim 11 wherein said housing includes an extended portion and a mounting member projecting from said extended portion, said mounting member including an arcuate neck portion which provides a resting surface for the housing against the user's ear.

15. The electronic headset of claim 11 wherein housing includes a mounting member connected to said extended portion such that said mounting member fits in the concha of the user's ear.

16. The electronic headset of claim 11 wherein housing includes a mounting member detachably connected to said extended portion such that said mounting member fits in the concha of the user's ear.

17. The electronic headset of claim 11 wherein said electronic circuitry is adapted to receive sound from a microphone disposed within said housing.

18. An earpiece, comprising:

a housing having a body extending between a first end and a second end, the first end comprising a mounting member having an endface surface, the mounting member being adapted to rest in a user's ear and to project in a first direction towards the auditory canal of the user's ear when resting in the user's ear, the endface surface defining a plane that extends in a second direction and a third direction, the second and third directions being substantially perpendicular to each other and the first direction, the body including at least one passageway that terminates proximate the first end; and a member connected to the housing proximate the second end for clamping the earpiece to the user's ear lobe, the member being movable away from the plane defined by the endface surface and operable to secure the earpiece against the user's ear lobe.

19. The earpiece of claim 18, wherein the housing extends generally downwardly when the earpiece is resting in the user's ear and the user is oriented in an upright position.

20. The earpiece of claim 18, further comprising an ear section that is adapted to be mounted to the first end and project towards the auditory canal.

21. The earpiece of claim 18, further comprising a pad that is adapted to fit over the first end.

* * * * *

UNITED STATES PATENT AND TRADEMARK OFFICE

CERTIFICATE OF CORRECTION

PATENT NO. : 7,031,485 B2
APPLICATION NO. : 10/664102
DATED : April 18, 2006
INVENTOR(S) : Meridyth Mischel Webber and Lawrence R. Stotts It is certified that error appears in the above-identified patent and that said Letters Patent is hereby corrected as shown below:

Column 4
Line 38, "T" should be deleted;

Column 9
Line 11, "members" should read --member--;

Column 10
Line 13 "head set" should read --headset --;

Column 10
Line 13 "head set" should read --headset--;
Line 27, "wherein housing" should read --wherein said housing --;
Line 31, "wherein housing" should read --wherein said housing--;

Signed and Sealed this

Fifth Day of September, 2006

JON W. DUDAS
*Director of the United States Patent and Trademark Office*